US009936550B2

(12) United States Patent
Chaoua et al.

(10) Patent No.: US 9,936,550 B2
(45) Date of Patent: Apr. 3, 2018

(54) ADAPTER FOR A LUMINAIRE CONTROLLER

(71) Applicant: GE Lighting Solutions, LLC, East Cleveland, OH (US)

(72) Inventors: Youcef Chaoua, Montreal (CA); Conrad Richard Merling, East Cleveland, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 14/947,381

(22) Filed: Nov. 20, 2015

(65) Prior Publication Data

US 2017/0150565 A1 May 25, 2017

(51) Int. Cl.

| | |
|---|---|
| ***H05B 37/02*** | (2006.01) |
| ***H05B 33/08*** | (2006.01) |
| ***F21V 23/06*** | (2006.01) |
| ***H01R 33/76*** | (2006.01) |

(52) U.S. Cl.

CPC ..... *H05B 33/0845* (2013.01); *F21V 23/06* (2013.01); *H01R 33/7607* (2013.01)

(58) Field of Classification Search

CPC H05B 37/02; H05B 37/0254; H05B 33/0845; F21V 23/06; H01R 33/7607

USPC ..... 315/291

See application file for complete search history.

(56) References Cited

U.S. PATENT DOCUMENTS

| | | | | |
|---|---|---|---|---|
| 4,947,302 | A * | 8/1990 | Callahan | H05B 37/029 315/312 |
| 8,138,690 | B2 * | 3/2012 | Chemel | F21V 29/67 315/294 |
| 9,049,753 | B1 * | 6/2015 | Wassel | H05B 37/02 |
| 9,363,860 | B1 * | 6/2016 | Lowchareonkul | H05B 37/00 |
| 2007/0027645 | A1 * | 2/2007 | Guenther | G01D 4/004 702/61 |
| 2012/0080944 | A1 * | 4/2012 | Recker | H02J 9/02 307/25 |
| 2013/0147367 | A1 * | 6/2013 | Cowburn | H05B 37/0254 315/152 |
| 2013/0210252 | A1 | 8/2013 | Ilyes | |
| 2014/0001977 | A1 * | 1/2014 | Zacharchuk | H04L 12/2816 315/291 |
| 2014/0015418 | A1 * | 1/2014 | Pandharipande | H05B 37/0218 315/152 |
| 2015/0002305 | A1 * | 1/2015 | Wells | H05B 37/0272 340/815.4 |
| 2015/0115807 | A1 | 4/2015 | Schroder et al. | |

(Continued)

OTHER PUBLICATIONS

European Search Report and Opinion issued in connection with corresponding EP Application No. 16198883.7 dated Feb. 8, 2017.

*Primary Examiner* — Don Le

(74) *Attorney, Agent, or Firm* — Peter T. DiMauro; GE Global Patent Operation

(57) ABSTRACT

There are provided an adapter and a method for use with a luminaire. For example, there is provided an adapter for use with a lighting controller of a luminaire. The adapter includes a calibration and maintenance port connected to a metering circuit disposed in the lighting controller. Furthermore, the adapter includes an interface connected to: the lighting controller, at least one lead of a lighting controller receptacle of the luminaire, and to at least one port of a computing device.

18 Claims, 6 Drawing Sheets

(56) References Cited

U.S. PATENT DOCUMENTS

| | | | | |
|---|---|---|---|---|
| 2015/0177280 | A1* | 6/2015 | Berringer | G01D 5/12 324/679 |
| 2016/0113096 | A1* | 4/2016 | Wagner | H05B 37/0272 315/307 |
| 2016/0301542 | A1* | 10/2016 | Davis | G08C 17/02 |

* cited by examiner

ADAPTER FOR A LUMINAIRE CONTROLLER

TECHNICAL FIELD

The present disclosure generally relates to luminaires. More particularly, the present disclosure relates to an adapter for performing various functions associated with a luminaire controller.

BACKGROUND

Calibration, maintenance, and development functions in luminaires are typically achieved using a combination of interfaces. These interfaces can include, for example, ANSI C136.41 receptacle pins and header pins disposed on the lighting controller itself. Alternatively, maintenance, calibration, and development can typically be performed solely through the ANSI C136.41 pins, albeit without a single adapter that can interface with the controller. Accordingly, there is a need for lighting control maintenance, calibration, and development procedures that are much simpler; in other words, there is a need for hardware that reduce the number of interfaces needed to perform at least the aforementioned functions.

SUMMARY

The embodiments featured herein help solve or mitigate the above-noted issues as well as other issues known in the art. Specifically, the embodiments enable all calibration and maintenance functions to be performed through a lighting controller receptacle's pins. The embodiments include all of the peripherals necessary to achieve calibration or maintenance functions through the receptacle pins, especially when the receptacle is implemented according to the ANSI C136.41 standard.

For example, in one embodiment, there is provided an adapter for use with a lighting controller of a luminaire. The adapter includes a WECO port that is designed by default to be connected to a metering circuit disposed in the lighting controller. Furthermore, the adapter includes an interface connected to the lighting controller, to at least one lead of a lighting controller receptacle of the luminaire, and to at least one port of a computing device.

In another exemplary embodiment, there is provided a method for use with a luminaire. The method includes interfacing a processor with the lighting control receptacle of the luminaire. The method further includes controlling, by the processor, parameters of the luminaire via an interface connected to the processor and to at least one lead of a lighting controller receptacle of the luminaire. Furthermore, the method can include performing, via a WECO port communicatively coupled to the processor and by the processor, one of a calibration function associated with the luminaire and a maintenance function associated with the luminaire.

In yet another exemplary embodiment, there is provided an adapter for use with a lighting controller of a luminaire. The adapter includes a first port connected to a metering circuit disposed in the lighting controller. The adapter further includes a second port connected to a processor of the lighting controller. Furthermore the adapter can include an interface that comprises the first port and the second port. The interface can be communicatively coupled to at least one lead of a lighting controller receptacle of the luminaire.

Additional features, modes of operations, advantages, and other aspects of various embodiments are described below with reference to the accompanying drawings. It is noted that the present disclosure is not limited to the specific embodiments described herein. These embodiments are presented for illustrative purposes only. Additional embodiments, or modifications of the embodiments disclosed, will be readily apparent to persons skilled in the relevant art(s) based on the teachings provided.

BRIEF DESCRIPTION OF THE DRAWINGS

Illustrative embodiments may take form in various components and arrangements of components. Illustrative embodiments are shown in the accompanying drawings, throughout which like reference numerals may indicate corresponding or similar parts in the various drawings. The drawings are only for purposes of illustrating the embodiments and are not to be construed as limiting the disclosure. Given the following enabling description of the drawings, the novel aspects of the present disclosure should become evident to a person of ordinary skill in the relevant art(s).

DETAILED DESCRIPTION

While the illustrative embodiments are described herein for particular applications, it should be understood that the present disclosure is not limited thereto. Those skilled in the art and with access to the teachings provided herein will recognize additional applications, modifications, and embodiments within the scope thereof and additional fields in which the present disclosure would be of significant utility.

Figure 1:
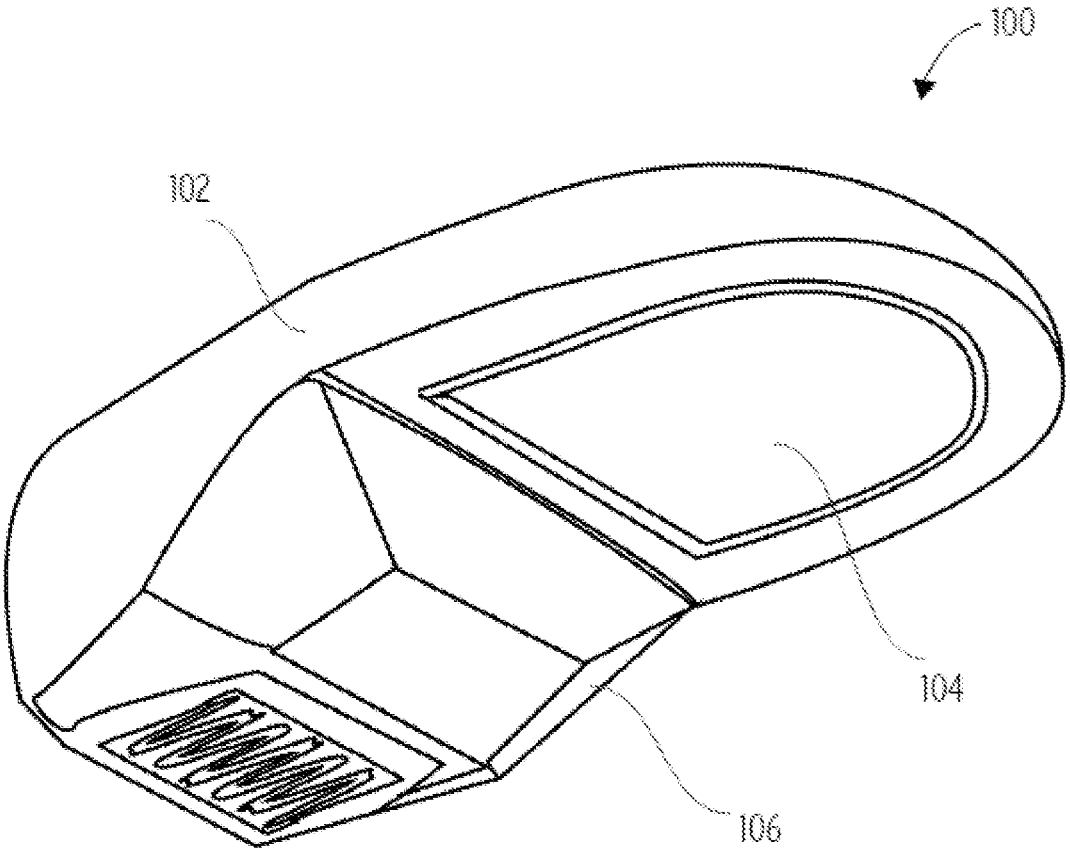
FIG. 1 is an illustration of a luminaire in which embodiments of the invention may be practiced.

FIG. 1 is an illustration of a luminaire 100 in which embodiments of the invention may be practiced. Luminaire 100 includes a dorsal portion 102 on to which is mounted a light receptor receptacle (not shown). Luminaire 100 further includes a cavity in which are placed light sources, such as light emitting diodes, for example. The cavity may be covered with a transparent glass 104 that serves to protect the light sources from the elements. In some embodiments, glass 104 may also function as a lens.

Luminaire 100 can further include a section 106 that is reserved for a wide variety of additional components. For example, section 106 may transparent and include cameras. Furthermore, in other embodiments, section 106 can include global positioning system (GPS) hardware.

Figure 2:
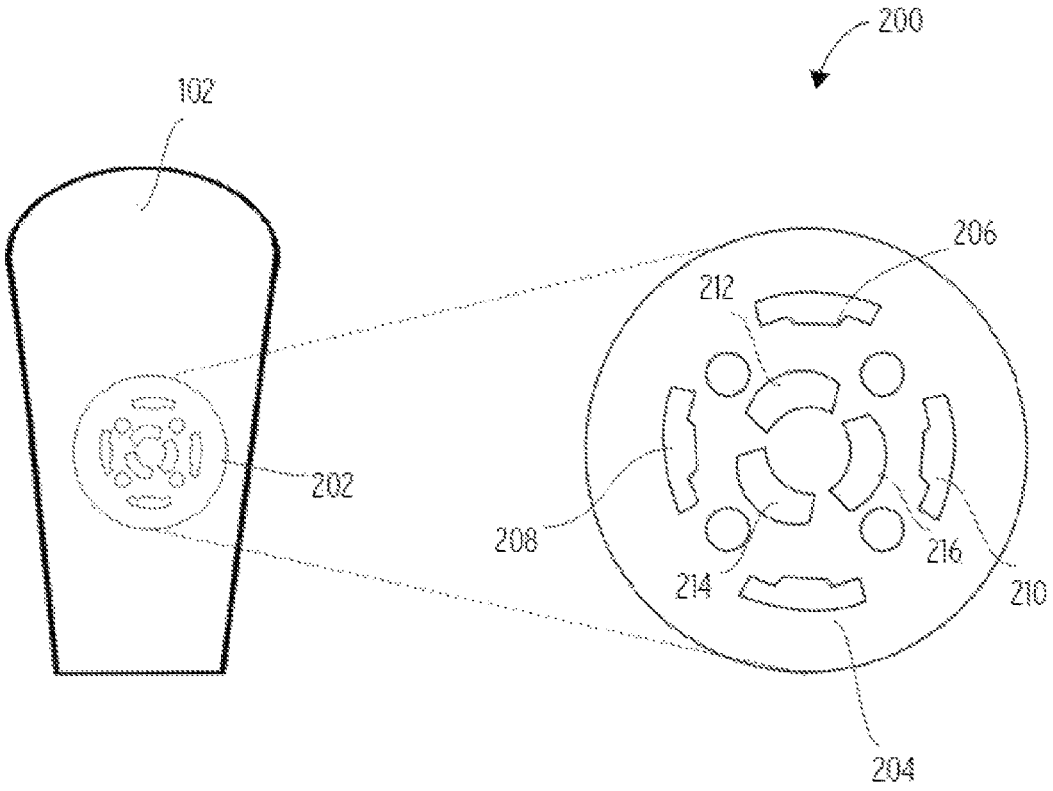
FIG. 2 is a top view of the luminaire of FIG. 1, according to an embodiment.

FIG. 2 is a top view 200 of luminaire 100. Specifically, top view 200 shows a lighting controller receptacle 204 disposed on the dorsal portion 202 of luminaire 100. Lighting controller receptacle 204 protrudes outward from the surface of dorsal portion 202 and it extend inward within the body of luminaire 100. Furthermore, on the inner side of lighting controller receptacle 204, i.e. the portion extending inward within the body of luminaire 100, there are disposed a plurality of leads.

In the exemplary embodiment shown in FIG. 2, lighting controller receptacle 204 includes a plurality of pins, which are pin 206, pin 208, pin 212, pin 210, pin 214, pin 216, and pin 218. Each of these pins is associated with one lead (not shown). Without loss of generality, hereinafter, a lead will be referred to with the numeral corresponding to the pin to which it is attached. For example, lead 210 will refer to the lead being attached to pin 210 on the inner side of the lighting controller receptacle 204.

Embodiments of the invention may include any controllers that interface through the standard lighting control receptacle of a luminaire, such as lighting controller receptacle 204. In some embodiments, lighting controller receptacle 204 may be defined using the ANSI C136.41 standard. That is, lighting controller receptacle 204 may have a 7-pin interface as shown in FIG. 2. Of the seven pins, three pins (212, 214, and 216) may be dedicated to providing power to a controller mounted on lighting controller receptacle 204. The remaining four pins may be dedicated to low-voltage signaling and control. For example, the pin 206 and pin 210 may be dedicated to 0-10V dimming and/or Digital Addressable Lighting Interface™ (DALI™), and pins 208 and 206 may be unassigned, i.e. they may be left for the manufacturer to define.

Figure 3:
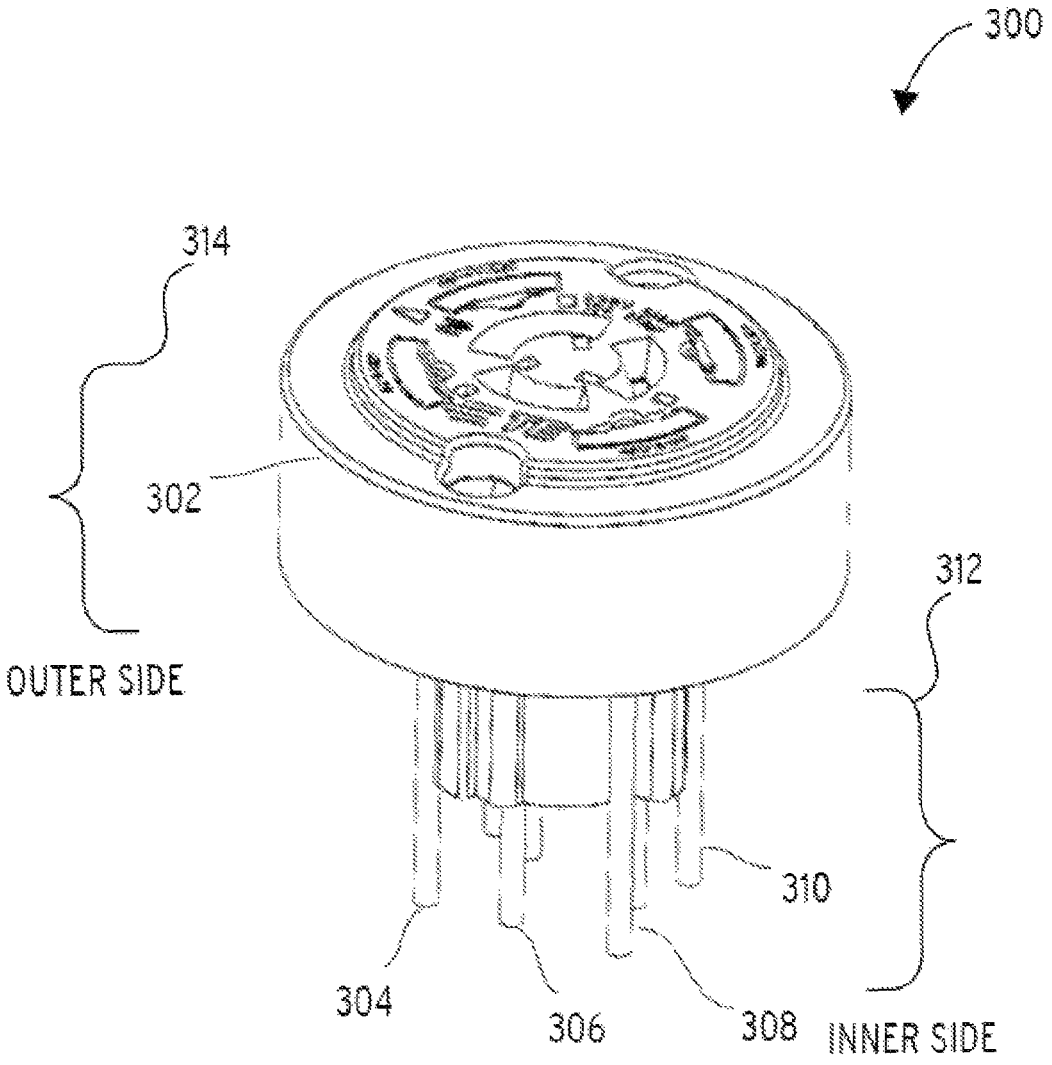
FIG. 3 is an illustration of a light lighting controller receptacle, according to an embodiment.

FIG. 3 is an illustration of a perspective view 300 of lighting controller receptacle 302. Outer side 314 corresponds to the portion of lighting controller receptacle 302 that is outside luminaire 100, i.e. the portion that protrudes outward from dorsal portion 102 of luminaire 100. Similarly, inner side 312 corresponds to the portion of lighting controller receptacle 302 that extends within luminaire 100. Leads 304, 306, 308, 310 correspond to pins 304, 306, 308, and 310, respectively.

Figure 4:
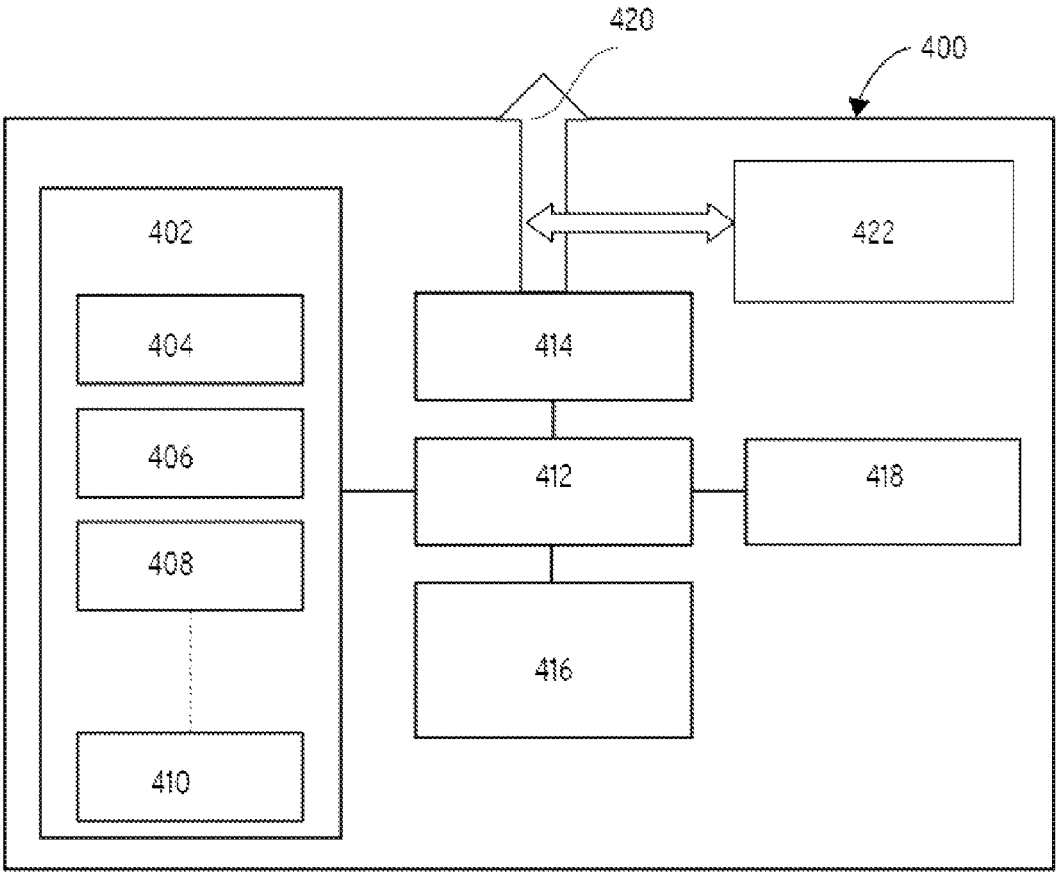
FIG. 4 is an illustration of a block diagram of a device, according to an embodiment.

FIG. 4 shows a block diagram of a device 400. Device 400 can include a bus 420 adapted to interface with lighting controller receptacle 202 or 302. In other words, bus 420 can have a connector that is designed to mate with lighting controller receptacle 202, in order to provide an interface between controller 400 and the components of luminaire 100.

Device 400 is a programmable device, or it may be a programmable module located in a much larger device. For example, device 400 can be part of a node mounted on lighting controller receptacle 202, the node having a plurality of functionalities. For example, the node may include a photo-electric element configured to sense ambient light and provide dimming commands to the luminaire, based on predetermined ambient light level thresholds.

Furthermore, the node may include wireless communication hardware, or communication hardware that use power line communication protocols. Furthermore, the node can include hardware for controlling one or more cameras located in luminaire 100, in addition to hardware capable of processing and transmitting data from the one or more cameras. One of skill in the art will readily recognize that such a node may have additional functionalities/hardware beyond those described herein.

Device 400 may include one or more hardware and/or software components configured to fetch, decode, execute, store, analyze, distribute, evaluate, and/or categorize information. Furthermore, device 400 may be battery-powered or it may include a power supply specifically suited for drawing power from a powerline or from a power supply of luminaire 100.

Device 400 can further include an interface 416, which may be a single adapter that encapsulates ports for all calibration, maintenance, and development functionality. In some embodiments, the lighting controller receptacle 204 or 302 may be implemented using a 7-pin ANSI C136.41 configuration. In these embodiments, interface 416, i.e. the single adapter, provides the capability to achieve all calibration, maintenance, and development functionalities through the 7-pin ANSI C136.41 configuration via interface 416 through bus 420.

Device 400 can include one or more processors like processor 412, a storage device 408, a memory 402 or the like, and input/output hardware (I/O module 414) configured to interface with bus 420 and lighting controller receptacle 202 (not shown in FIG. 4).

Processor 412 may include one or more processing devices or cores (not shown). In some embodiments, processor 412 may be a plurality of processors, each having either one or more cores. Processor 412 can be configured for execution of instructions fetched from memory 402, for example from one of memory block 404, memory block 406, memory block 408, or memory block 410, or the instructions may be fetched from storage device 408, or from a remote device connected via interface 416.

Furthermore, without loss of generality, storage device 418 and/or memory 402 may include a volatile or non-volatile, magnetic, semiconductor, tape, optical, removable, non-removable, read-only, random-access, or other type of storage device or non-transitory computer-readable computer medium. Storage device 418 and/or memory 402 may include programs and/or other information that may be used by processor 412.

Storage device 418 may be configured to log data processed, recorded, or collected during the operation of device 400. The data may be time-stamped, GPS-tagged, cataloged, indexed, or organized in a variety of ways consistent with data storage practice, and this without departing from the scope of the present disclosure.

The functionality of device 400 is imparted by its structure. Namely, the structure of device 400 is provided by the software or firmware contained in a plurality of memory sectors of memory 402, of which only memory block 404, memory block 406, memory block 408, and memory block 410 are shown for clarity.

In some embodiments, for example, memory block 404 may include instructions that, when executed by processor 410, cause processor 410 to calibrate one or more circuits or circuit parameters (e.g. driver current, operating voltage, etc.) in luminaire 100. Calibration may entail setting a driver current set point, or it may entail setting up a look up table correlating values of current measurements with lumen output.

Further, by way of example, memory block 408 can include instructions that cause processor 412 to program ON and OFF schedules for the luminaire, or development functions. Development functions may include programming the electrical parameters of the luminaire 100, or loading programs into memory 402 for use by device 100 once luminaire 100 is deployed, with the device 400 mounted therein.

All instructions for performing calibration, maintenance, or development functions can be loaded via a single interface 416, which can include WECO and USB ports, in addition to a barrier block that provides the single interface. The WECO port may comprise a port manufactured or sold under the "WECO" brand name (e.g., by WECO Electrical Connectors Inc.), or a port that is manufactured or sold under some other brand name but that conforms to the electrical and/or mechanical configuration of a WECO™ brand port. Alternatively, the interface can be a port to any suitable meter testing device.

One of ordinary skill in the art will readily recognize that although the ANSI C136.41 is disclosed herein as an exemplary implementation for lighting controller receptacle 202 or 302, the invention is not limited to luminaires that include receptacles implemented according to that standard. Rather, the invention may be practiced with any luminaire, and other standards may be used, so long as a single interface is provided for performing the disparate set of functions (e.g. calibration, maintenance, and development) via the receptacle.

Further, while only calibration, maintenance, and development functions are described, one of ordinary skill in the art will readily recognize that other functions can be implemented via the single interface. Furthermore, while FIG. 4 shows specific connections between the exemplary constituent blocks of device 400, such connections are not limiting.

For example, in some alternate embodiments, device 400 can include an interface 416 that is connected directly to bus 420 and metering circuit 422. In these embodiments, all memory and processing functions can simply be implemented using a computing device that is connected to interface 416 via the single interface, the interface 416 being configured to support WECO and USB protocols, for example.

Furthermore, device 400 may include a metering circuit 522, which may be programmed to measure and/or estimate any electrical parameters associated with the power consumption by the luminaire. Such measures or estimates may include current, voltage, power dissipation, power factor, phasor data, and like measurements.

Figure 5:
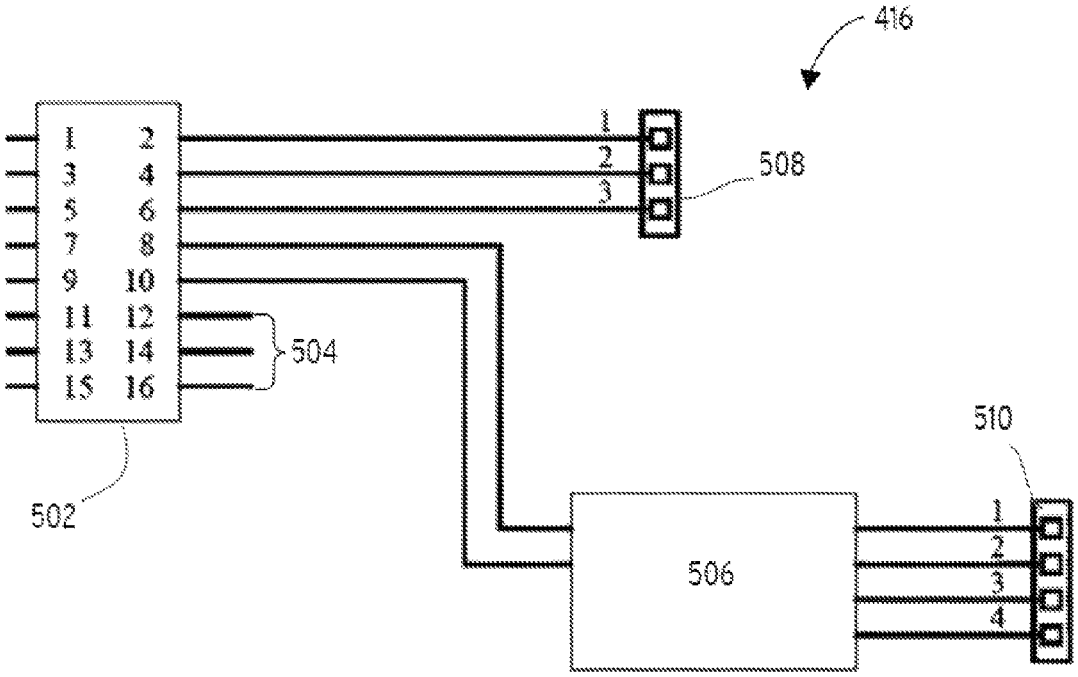
FIG. 5 is an illustration of an interface, according to an embodiment.

FIG. 5 is an illustration of interface 416, according to an embodiment. Interface 416 can include a barrier block 502 that provides connections to a plurality of connectors, each supporting a distinct communication protocol. For example, barrier block 502 provides a connection to a first port 508, which can be configured to support a first protocol. For example, in one embodiment, first port 508 may be a WECO port, and it may support connections to meter reading equipment that can be used to read data from metering circuit 422 (see FIG. 4).

Second port 510 can be a USB port configured to allow a developer to program device 400 to perform specific tasks, such as loading/reading calibration data, performing maintenance functions, etc. In some embodiments, there may be a single circuit board 506 disposed between the second port 510 and barrier block 502. Circuit board 506 may be used to process signals originating from barrier block 502 to provide a signal format suitable for second port 510.

For example, in one embodiment, signals originating from the two unassigned leads of the lighting controller receptacle 204 or 302 may be routed via receptacle pins 504 to pins 8 and 10 of barrier block 502. These signals may be converted to a proper format for outputting via second port 510. In one embodiment, the formatting may include serializing the data originating from pins 8 and 10 of barrier block 502.

Barrier block 502 further provides a connection to the lighting controller receptacle 204 or 302, via receptacle pins 504 (for example). In the embodiment shown in FIG. 5, only three receptacle pins are shown, but barrier block 502 may be implemented to provide connections to all the pins of lighting controller receptacle 204 or 302. In some embodiments, the lighting controller receptacle 204 may be implemented according to the ANSI C136.41 standard.

Figure 6:
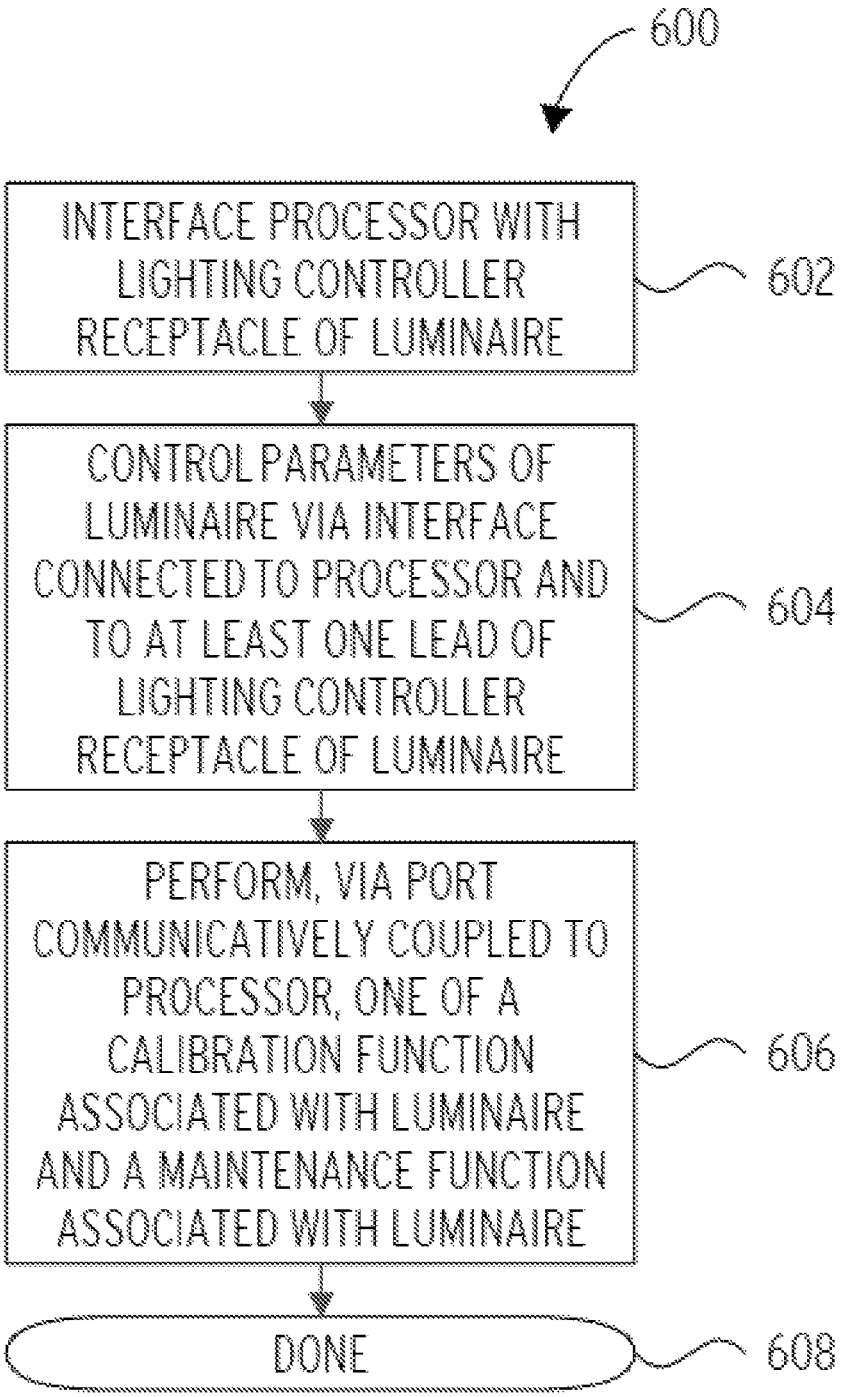
FIG. 6 illustrates a method, according to an embodiment.

Having set forth the structure of various exemplary embodiments of the invention, a method 600, consistent with the embodiments, is now described with respect to FIG. 6.

Method 600 can include interfacing a processor with the lighting control receptacle of the luminaire (step 502). The processor can be like the one described in the context of FIG. 4. Generally speaking, step 602 can include interfacing an entire controller like device 400 with lighting controller receptacle 302.

Method 600 can include a step 604 that includes controlling, by the processor, electrical parameters of the luminaire via an interface connected to the processor and to at least one lead of a lighting controller receptacle of the luminaire. The parameters may be such as the ones previously described.

Further, method 600 can include a step 606, wherein the processor performs, via a WECO port communicatively coupled to the processor, one of a calibration function associated with the luminaire and a maintenance function associated with the luminaire. Such functions may be like the ones described above. In one embodiment, method 600 may end at step 608.

In some embodiments, method 600 may further include interfacing the processor with seven leads included in the lighting controller receptacle. In such a case, the receptacle is implemented according to the ANSI C136.41 standard, and method 600 may further include interfacing the processor with at least one lead of the lighting controller receptacle.

In some embodiments, method 600 may further include interfacing the processor with all the leads of the receptacle. Furthermore, method 600 may further include communicating with the processor via a USB port.

Those skilled in the relevant art(s) will appreciate that various adaptations and modifications of the embodiments described above can be configured without departing from the scope and spirit of the disclosure. Therefore, it is to be understood that, within the scope of the appended claims, the disclosure may be practiced other than as specifically described herein.

What is claimed is:

1. An adapter, for use with a lighting controller of a luminaire, the adapter comprising:

a port for connecting to a meter testing device; and an interface connected to (i) the lighting controller, (ii) to at least one lead of a lighting controller receptacle of the luminaire, wherein the lighting controller receptacle is implemented according to the ANSI C136.41 standard, and (iii) at least one USB port.

2. The adapter of claim 1, wherein USB port is configured to provide a connection between the lighting controller and a computing device.

3. The adapter of claim 1, wherein the interface is connected to a subset of the leads of the lighting controller receptacle.

4. The adapter of claim 1, wherein the interface is connected to all leads of the lighting controller receptacle.

5. The adapter of claim 1, wherein the interface includes a barrier block.

6. The adapter of claim 5, wherein the barrier block include pins associated with leads of the lighting controller receptacle.

7. The adapter of claim 5, wherein the barrier block includes pins associated with the port for connecting to a meter testing device.

8. The adapter of claim 5, wherein the barrier block includes pins associated with the USB port.

9. The adapter of claim 8, wherein the adapter further includes a circuit board connected to the USB port and to the pins associated with the USB port.

10. A method, for use with a luminaire, the method comprising:

interfacing a processor with the lighting control receptacle of the luminaire; and controlling, by the processor, parameters of the luminaire via an interface connected to (i) the processor, (ii) at least one lead of a lighting controller receptacle of the luminaire, and (iii) at least one port of a computing device; and performing, by the processor, via a port for connecting to a meter testing device, the port for connecting to a meter testing device being communicatively coupled to the processor, at least one of a calibration function associated with the luminaire and a maintenance function associated with the luminaire.

11. The method of claim 10, further comprising interfacing the processor with seven leads included in the lighting controller receptacle.

12. The method of claim 10, wherein the receptacle is implemented according to the ANSI C136.41 standard, and the method further comprises interfacing the processor with at least one lead of the lighting controller receptacle.

13. The method of claim 10, further comprising interfacing the processor with all the leads of the receptacle.

14. The method of claim 10, wherein the at least one port of the computing device includes a USB port, and the method further comprises communicating with the processor via the USB port.

15. An adapter, for use with a lighting controller of a luminaire, the adapter comprising:

a first port connected to a metering circuit disposed in the lighting controller;

a second port connected to a processor of the lighting controller; and an interface include the first port and the second port, the interface being communicatively coupled to at least one lead of a lighting controller receptacle of the luminaire, wherein the lighting controller receptacle is implemented according to the ANSI C136.41.

16. The adapter of claim 15, wherein the second port is a USB port.

17. The adapter of claim 15, wherein the interface includes a barrier block.

18. The adapter of claim 16, wherein the interface includes a circuit board communicatively coupled to the USB port and to the processor.

* * * * *